US008348174B2

(12) United States Patent
Baker

(10) Patent No.: US 8,348,174 B2
(45) Date of Patent: Jan. 8, 2013

(54) ADVANCED WATER AND ENERGY CONSERVING SHOWER AND CLEANING SYSTEMS AND METHODS

(76) Inventor: Larry K. Baker, Mokelumne Hill, CA (US)

( * ) Notice: Subject to any disclaimer, the term of this patent is extended or adjusted under 35 U.S.C. 154(b) by 0 days.

(21) Appl. No.: 12/817,715

(22) Filed: Jun. 17, 2010

(65) Prior Publication Data

US 2011/0079656 A1 Apr. 7, 2011

Related U.S. Application Data

(60) Provisional application No. 61/247,701, filed on Oct. 1, 2009.

(51) Int. Cl.

| | |
|---|---|
| ***A62C 5/02*** | (2006.01) |
| ***B05B 9/00*** | (2006.01) |
| ***F23D 11/16*** | (2006.01) |
| ***F23D 11/10*** | (2006.01) |
| ***E03C 1/08*** | (2006.01) |

(52) U.S. Cl. ..... 239/8; 239/124; 239/398; 239/419; 239/422; 239/423; 239/428.5

(58) Field of Classification Search ..... 239/8, 103, 239/104, 120, 124, 125, 126, 127, 209, 270, 239/290, 398, 407, 413, 416.4, 416.5, 418, 239/419, 419.5, 422, 423, 428, 428.5, 434.5
See application file for complete search history.

(56) References Cited

U.S. PATENT DOCUMENTS

| | | | | |
|---|---|---|---|---|
| 3,281,864 | A * | 11/1966 | Linnehan | 4/537 |
| 3,965,494 | A * | 6/1976 | Baker | 4/615 |
| 4,072,270 | A * | 2/1978 | Harmony | 239/428.5 |
| 5,206,963 | A * | 5/1993 | Wiens | 4/603 |
| 5,293,654 | A * | 3/1994 | Castwall et al. | 4/598 |
| 6,581,220 | B2 * | 6/2003 | Yekutiely et al. | 4/661 |
| 7,032,840 | B2 * | 4/2006 | Freidell | 239/307 |
| 2001/0010340 | A1 * | 8/2001 | Utter et al. | 239/419 |
| 2010/0252658 | A1 * | 10/2010 | Honeyands | 239/398 |

* cited by examiner

*Primary Examiner* — Ryan Reis

(57) ABSTRACT

Systems and methods for energy-saving and water-saving devices are disclosed. In some embodiments, a head assembly is coupled to receive a liquid flow from a liquid supply and a gas flow from a gas supply, wherein the head assembly defines a mixing region configured to receive the liquid flow and the gas flow, and a dispensing portion configured to receive a combined flow from the mixing region. In some implementations, a spray nozzle may sprayably introduce the liquid flow into the mixing region. In other implementations, a plurality of curtain flows may be drawn through apertures into the dispensing portion by the combined flow. In still other implementations, a portion of the combined flow dispensed by the head assembly may be recaptured into the gas flow.

25 Claims, 5 Drawing Sheets

ADVANCED WATER AND ENERGY CONSERVING SHOWER AND CLEANING SYSTEMS AND METHODS

CROSS-REFERENCE TO RELATED APPLICATIONS

This patent application claims the benefit of, commonly-owned U.S. Provisional Patent Application No. 61/247,701 entitled "Advanced Water and Energy Conserving Shower and Cleaning Systems and Methods," filed on Oct. 1, 2009, which application is incorporated herein by reference.

FIELD OF THE INVENTION

The present disclosure is directed to energy-saving and water-saving shower and cleaning systems and methods.

BACKGROUND OF THE INVENTION

Energy conservation and fresh water availability are important issues in the world today, raising the importance of significant conservation of these resources. Reducing heated water consumption during routine tasks such as showering and cleaning is one of the most effective ways to conserve fresh water and the energy used to heat it. Prior art systems designed to reduce fresh water consumption in showering and cleaning applications include those systems disclosed, for example, in U.S. Pat. No. 4,614,303 issued to Moseley, and U.S. Patent Application Publication No. 2004/0251325 A1 differing means of flow control were employed which simply reduced the water coming out of the nozzle. Both of these technologies allowed the user to adjust the flow into the range of 2.5 to 4 gpm which means that only minor water savings might result. U.S. Pat. No. 3,965,494 issued to Baker added forced air to the fixed water flow rate of 0.5 to 0.75 gpm. The shower unit had to be constructed into the bathroom and permanently plumbed into the water system. The air/water nozzle was configured to allow the combined stream to reach the floor with water droplets to provide washing of the feet of the bather. The air mover used was 800 watts. Although desirable results have been achieved using such systems and methods, there is significant room for improvement.

SUMMARY

The present disclosure teaches water-saving shower and cleaning systems and methods which may result in revolutionary reductions in the energy required for these applications. Embodiments of systems and methods in accordance with the teachings of the present disclosure may advantageously provide dramatic improvements in energy and water conservation during routine showering and cleaning operations in comparison with prior art systems. Improvements in energy and water conservation afforded by systems and methods disclosed herein may be realized in a variety of applications and environments, including routine showering for personal hygiene, or the cleaning of equipment and other devices. For applications involving heated water, the reduction in water consumption leads to substantial reductions in energy consumption necessary for heating the water. The shower embodiment has been shown to conserve more energy than solar water heating systems with a 90% reduction in installed cost and a 95% reduction in bathing water use. Other advantages provided by energy-saving and water-saving systems and methods in accordance with the present disclosure will become apparent during review of the following disclosure.

BRIEF DESCRIPTION OF THE DRAWINGS

Embodiments of the present disclosure are described in detail below with reference to the following drawings.

DETAILED DESCRIPTION

Figure 1:
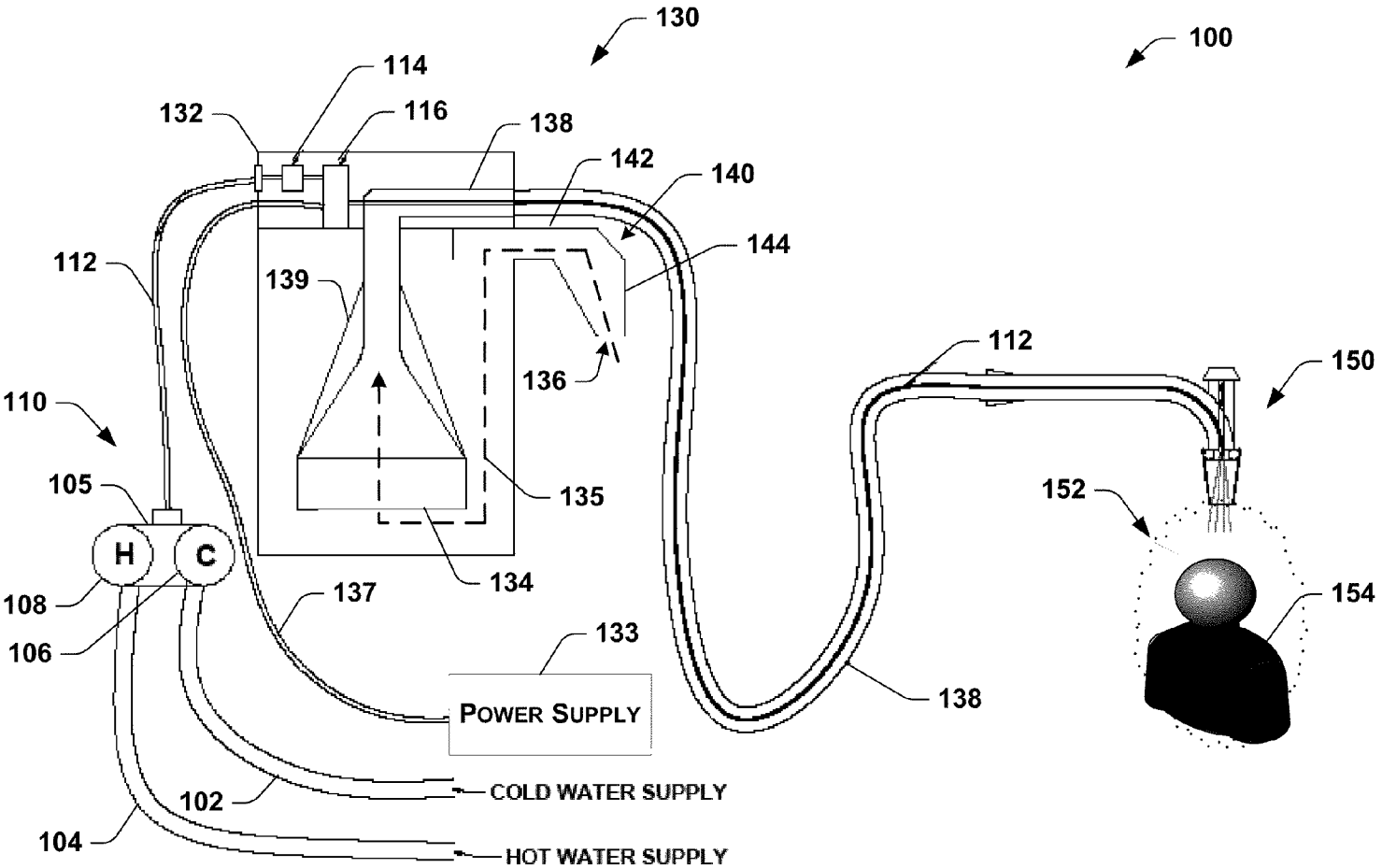
FIG. 1 is a schematic, partial-sectional view of an exemplary water-saving shower system in accordance with an embodiment of the present disclosure.

The present disclosure is directed to systems and methods for water and energy-saving shower devices. Many specific details of certain embodiments in accordance with the present disclosure are set forth in the following description and in FIGS. 1-9 to provide a thorough understanding of such embodiments. One skilled in the art, however, will understand that the present invention may have additional embodiments, or that the invention may be practiced without several of the details described in the following description.

In the following discussion, various aspects of systems and methods in accordance with the present disclosure will be described using the term "water." It should be appreciated, however, that systems and methods in accordance with the present disclosure may be used to deliver a wide variety of suitable fluids, liquids, fluidic substances, solutions, or mixtures. Therefore, unless otherwise specifically stated, references to the substance "water" in the following disclosure are intended to be merely exemplary and non-limiting, and should be read to include (or be interchangeable with) any other suitable fluids, liquids, fluidic substances, solutions, or mixtures.

The present disclosure technology allows accomplishments which were heretofore impossible. For example, the shower embodiment of the present disclosure weighs approximately 5 pounds and is installed by hanging it over a shower door or curtain rod. An intake to the power-head draws air from the bathing enclosure. The power head plugs into a standard 120 volt outlet and draws 2 amps. The water supply tube hooks to the existing plumbing goose neck in the shower. This portability, ease of installation, low water flow, and low energy requirement for water heat and power make it a technology which allows bathing and cleaning in situations and locations where it was never before feasible. The following application examples illustrate the sharp contrast between the ⅛ gpm (gallons per minute) flow rate of this embodiment and the 2.5 gpm flow rate of a standard "low flow" shower.

1. A soldier can bathe in ½ gallon of water using military shower techniques, now he only gets to bathe once a week in 10 gallons of water.

2. Home-owners can quickly install two of the shower embodiments in their home for 1/10 the cost of installing a recirculation solar water heating system yet save more energy in the average continental US installation. This solution to energy conservation also works regardless of the weather, whereas solar is weather and geographic location dependent.
3. Disaster relief responders can bathe 500 people in 500 gallons of water, using this embodiment for 8 minute showers instead of bathing only 25 people using "low flow" technology.
4. Special applications where water and wastewater must be carried (e.g. Recreational Vehicles, Boats, etc.), where opportunities to resupply are limited, will benefit greatly from the use of the technology.

This technology was not developed by modifying existing means of cleaning, but was instead developed to provide an equivalent cleaning/experience interface to the user. The user's expectations and the physical results outcome are accepted as design constraints.

The potential energy savings which may be realized through broad application of the present disclosure are far-reaching and even dwarf the energy directly associated with heating the water for showering. These include substantially reduced infrastructure for obtaining, storing, transporting and delivering freshwater, as well as collecting, storing, transporting, and treating wastewater.

FIG. 1 is a schematic, partial-sectional view of an exemplary water-saving shower system 100 in accordance with an embodiment of the present disclosure. In this embodiment, the shower system 100 includes a supply assembly 110, a capture assembly 130, and a head assembly 150. In brief, a liquid (e.g. water) may be delivered by the supply assembly 110 to the head assembly 150. Similarly, the capture assembly 130 provides a suitable gaseous substance (e.g. air, air/water vapor, etc.) to the head assembly 150. The head assembly 150 combines the liquid (e.g. water) provided by the supply assembly 110 and the gaseous substance (e.g. air/water vapor) provided by the capture assembly 130, and delivers a combined liquid/gas mixture onto a workpiece. In some embodiments, the exemplary shower system 100 may be used as a system for showering humans for personal hygiene.

Throughout this description, systems and methods in accordance with the present disclosure may be described using the terms "air," "water vapor," or other specific gaseous substances. It should be appreciated, however, that systems and methods in accordance with the present disclosure may be used in combination with a wide variety of suitable gaseous substances, vapors, or gaseous/vaporous mixtures. Therefore, unless otherwise specifically stated, references to the substance "air" or "water vapor" throughout this disclosure are intended to be merely exemplary and non-limiting, and should be read to be interchangeable with any other suitable gaseous substances, vapors, or gaseous/vaporous mixtures.

Similarly, throughout this description, systems and methods in accordance with the present disclosure may be described using the terms "water," or "water-saving," or may include other references to specific liquids. It should be appreciated, however, that systems and methods in accordance with the present disclosure may be used in combination with a wide variety of suitable liquids, liquidic substances, or liquid-containing mixtures. Therefore, unless otherwise specifically stated, references to "water" or "water-saving" throughout this disclosure are intended to be merely exemplary and non-limiting, and should be read to be interchangeable with any other suitable liquids, liquidic substances, or liquid-containing mixtures.

Returning again to FIG. 1, in some embodiments, the supply assembly 110 may include cold and hot supply lines 102, 104 coupled to a manifold 105 having cold and hot control valves 106, 108. A liquid supply line 112 may extend from the manifold 105 to the capture assembly 130. The supply assembly 110 may also include a flow rate controller 114 to control a flow rate through the liquid supply line 112, and a pressure switch 116 which is used to actuate (e.g. turn on) the gas flow. As shown in FIG. 1, in some embodiments, the flow rate controller 114 or the pressure switch 116 may be disposed within a housing 132 of the capture assembly 130, while in other embodiments; the components of the supply assembly 110 may be separate from those of the capture assembly 130.

The capture assembly 130 may further include a fan unit 134 disposed within the housing 132. The fan unit 134 may be configured to draw a gas supply flow 135 (e.g. air, water vapor, etc.) through an intake aperture 136 disposed within the housing 132, and to provide a gas supply flow 135 to a gas supply line 138. For example, in some embodiments, the fan unit 134 may provide the gas supply flow 135 through a diffuser 139 to the gas supply line 138. In alternate embodiments, a pressurized source of gas (e.g. a gas bottle) may provide the gas supply flow 135. A power supply 133 (e.g. battery, generator, electrical outlet, solar panel, etc.) may provide electrical power via a power supply line 137 to pressure switch 116 to turn on the air flow when liquid pressure is sensed in line 112, or to any other desired portion of the shower system 100.

As shown in FIG. 1, the gas supply line 138 extends from the capture assembly 130 to the head assembly 150, and the liquid supply line 112 extends from the supply assembly 110 to the head assembly 150 (e.g. via the capture assembly 130). In some embodiments, the liquid supply line 112 may be disposed within, or coupled to, the gas supply line 138. Alternately, the liquid and gas supply lines 112, 138 may be partially or completely separate. As noted above, the head assembly 150 combines the liquid (e.g. water) provided by the supply assembly 110 and the gaseous substance (e.g. air/water vapor) provided by the gas supply line 138, and delivers a combined liquid/gas mixture 152 onto a workpiece, such as a person 154.

Figure 2:
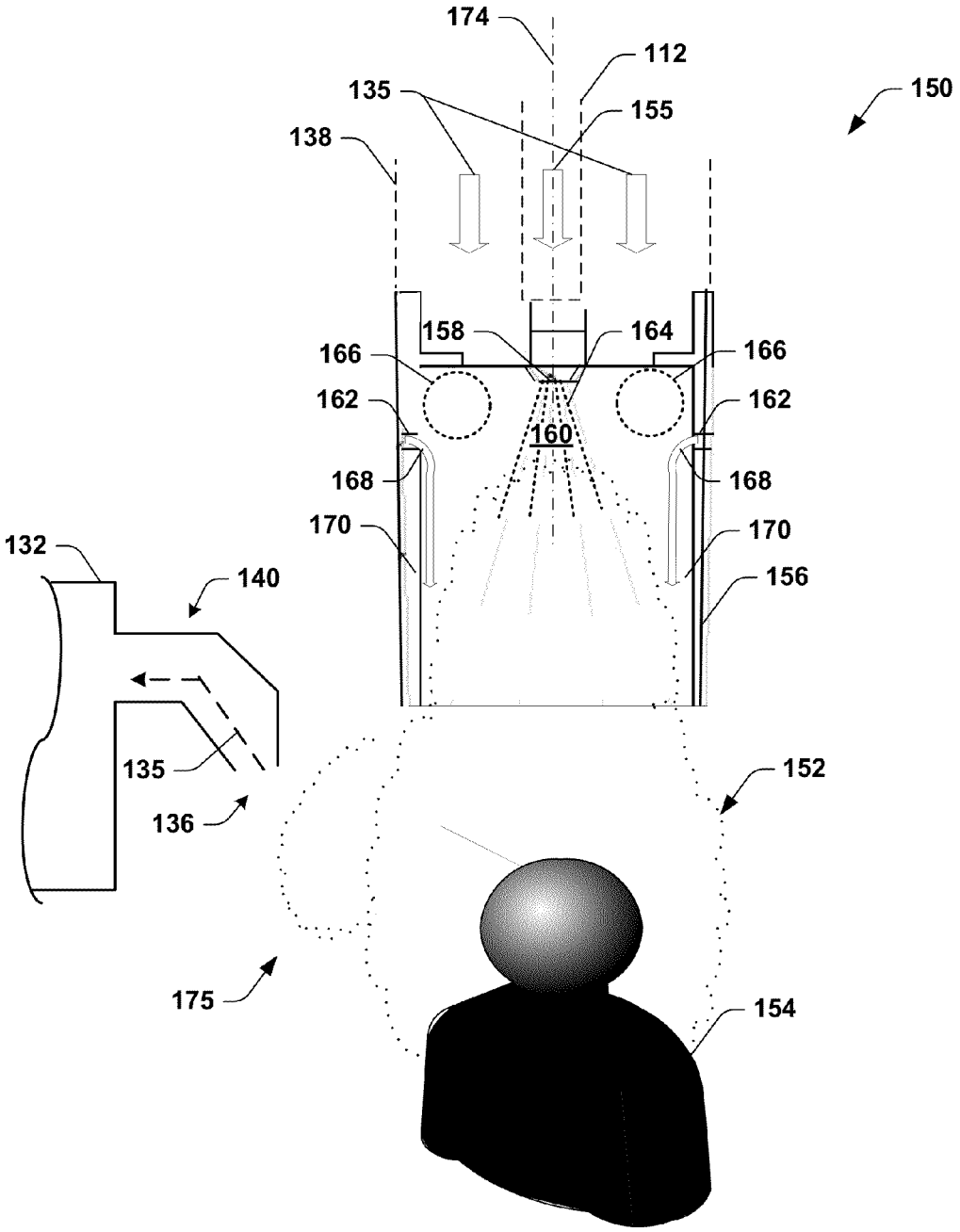
FIG. 2 is an enlarged, side cross-sectional view of a head assembly of the shower system of FIG. 1 in accordance with an embodiment of the present disclosure.

FIG. 2 is an enlarged, side cross-sectional view of the head assembly 150 of FIG. 1 in accordance with an embodiment of the present disclosure. More specifically, in some embodiments, the head assembly 150 includes an outer housing 156 coupled to receive the gas supply flow 135 from the gas supply line 138, and a nozzle 158 disposed within the outer housing 156 and coupled to receive a liquid supply flow 155 from the liquid supply line 112. In some implementations, the nozzle 158 is positioned approximately along a longitudinal axis of the outer housing 156, and the gas supply flow 135 is approximately annularly disposed about the nozzle 158. A plurality of curtain-flow ports 162 (two shown) may be disposed through the outer housing 156. In operation, the nozzle 158 dispenses the liquid supply flow 155 into a mixing region 160, while the gas supply flow 135 flows into the mixing region 160 approximately annularly disposed about the nozzle 158. Of course, other suitable configurations for introducing the gas supply flow 135 and liquid supply flow 155 into the head assembly 150 may be conceived.

Figure 3:
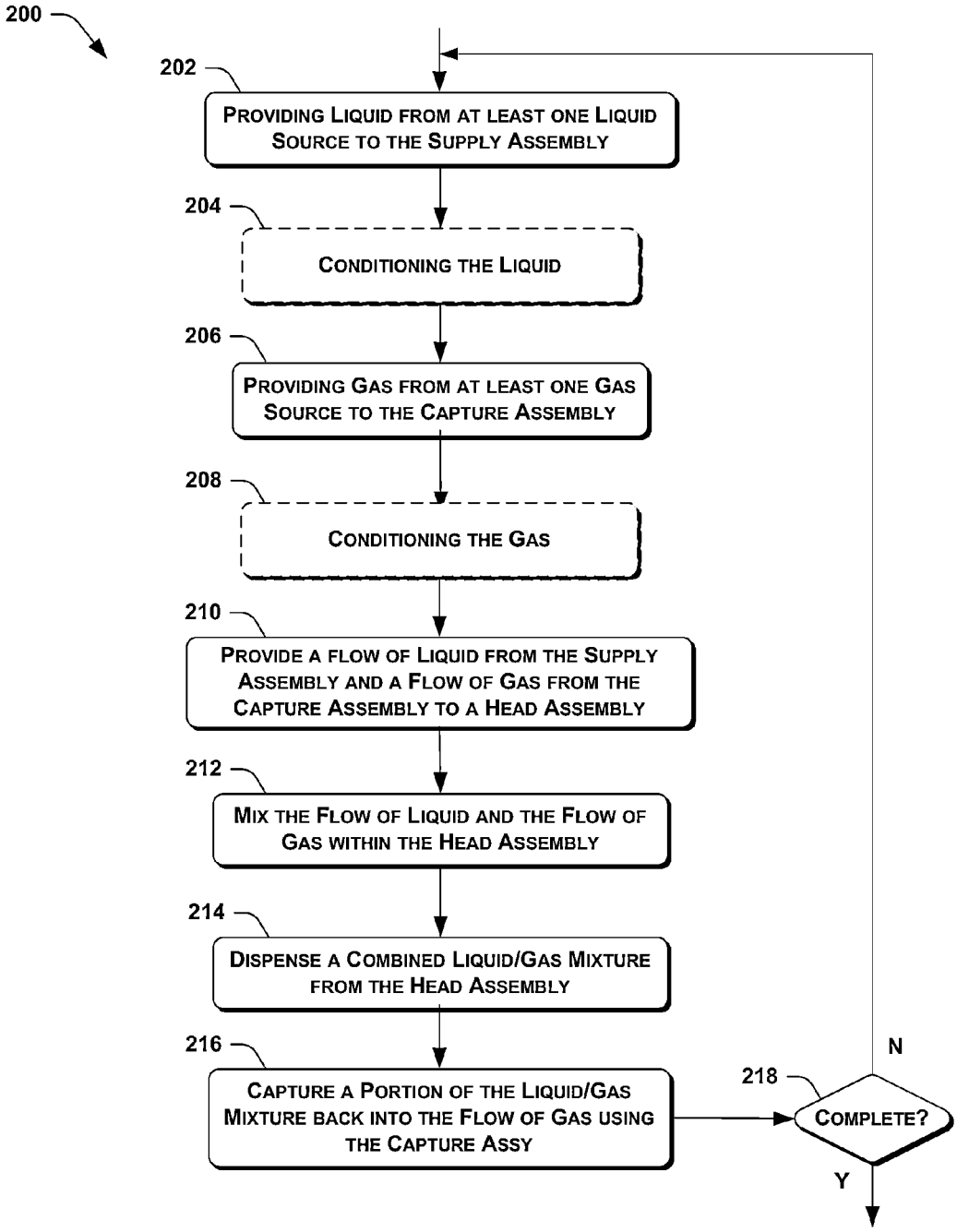
FIG. 3 is a flow diagram of a method of operating a water-saving shower device in accordance with still another embodiment of the present disclosure.

FIG. 3 shows a flow diagram of a method 200 of operating a water-saving shower system in accordance with an embodiment of the present disclosure. For simplicity, the method 200 will be described with reference to the exemplary shower system 100 described above with reference to FIGS. 1 and 2. In this embodiment, the method 200 includes providing liquid from at least one liquid source to a supply assembly (e.g. supply assembly 110) at 202. The liquid source may be a tank, a reservoir, a water heater, a pump, a well, a stream, or any other suitable source of liquid.

In some embodiments, the liquid may be conditioned by the supply assembly at 204. For example, a flow rate of the liquid may be regulated using a flow rate controller 114 (e.g. a choke plate, a valve, or other suitable device). Similarly, a pressure of the liquid may be controlled using a pressure regulator, or other suitable device). In further embodiments, the liquid may be heated, cooled, mixed, or conditioned in any other way by the supply assembly.

As further shown in FIG. 3, the method 200 includes providing a gas or gaseous mixture (e.g. water vapor) from at least one gas source to a capture assembly (e.g. capture assembly 130). The gas source (or sources) may be a fan (or blower) unit, a pressure bottle, a pump, or any suitable source or type, and the gas or gaseous mixture may be any desired substance. For example, in some implementations, the gas may include air, and the at least one gas source may include an ambient atmosphere. In further implementations, the gas may include a mixture of air and water vapor.

In some implementations, the gas may be conditioned at 208. For example, the gas may be heated or cooled, or the flow rate, pressure, humidity, or any other suitable characteristic of the gas or gaseous mixture may be regulated or adjusted, or any other suitable conditioning of the gas may be performed. More specifically, in some embodiments, the gas or gaseous mixture may be conditioned at 208 using the capture assembly or any other portion of the shower system. For example, as shown in FIG. 1, in some embodiments, the shower system may be configured to enable heat transfer between the liquid supply flow and the gas supply flow. More specifically, in the embodiment shown in FIG. 1, the liquid supply line 112 may be coupled to and/or disposed within the gas supply line 138. In some implementations, this arrangement may permit heat to transfer between the liquid within the liquid supply line 112 and the gas within the gas supply line 138. In the shower embodiment reducing the flow of gas may be desired during conditioning of the shower enclosure during warm-up and to maintain humidity and temperature during bathing idle times.

With continued reference to FIG. 3, a flow of liquid from the supply assembly and a flow of gas from the capture assembly are provided to a head assembly (e.g. head assembly 150) at 210, and the flow of liquid and the flow of gas are mixed within the head assembly at 212. For example, with reference to the embodiment shown in FIG. 2, in some implementations, the flow of liquid and the flow of gas may be introduced into a mixing region (e.g. mixing region 160) of the head assembly 150. A combined liquid/gas mixture (e.g. a resulting liquid/gas mixture 152) is dispensed from the head assembly at 214. More specifically, in some implementations (e.g. the head assembly 150 shown in FIG. 2), a nozzle 158 receives the liquid supply flow 155 and emits a liquid spray 164 into a mixing region 160 of the head assembly 150. Simultaneously, the gas supply flow 135 from the gas supply line 138 enters the mixing region 160 to mix with the liquid spray 164. The nozzle 158 may be disposed along a longitudinal axis 174 of the head assembly 150 or a portion thereof (e.g. the mixing region 160). In some implementations, the nozzle 158 may be configured to provide an approximately conical liquid spray 164 into the mixing region 160 to enhance the mixing of the gas supply flow 135 and the liquid spray 164 within the mixing region 160. In a particular implementation, the nozzle 158 may be a Model No. MAB36MY nozzle commercially-available from MAXIJET, Inc. of Dundee, Fla. Again, the resulting liquid/gas mixture 152 is emitted by the head assembly 150 onto the person 154 or other desired workpiece.

Depending on the particular application, the characteristics of the liquid/gas mixture 152 may be varied by adjusting the relative sizes of the liquid supply flow 155 and the gas supply flow 135. For example, in some embodiments of showering systems for personal hygiene using water and ambient air (at approximately sea level), liquid supply flows 155 ranging from approximately 0.1 gallons per minute up to 0.5 gallons per minute, and gas supply flows 135 ranging from approximately 25 cubic foot per minute to approximately 40 cubic feet per minute, have been effectively employed. In a presently-preferred embodiment, in a showering system for personal hygiene, a liquid supply flow rate of approximately 0.125 gallons per minute has been successfully employed. In alternate embodiments, any other suitable flow rates (liquid or gas) or volumetric gas/liquid ratios may be employed as desired to achieve the desired characteristics (e.g. wetness/humidity, pressure, impulse, temperature, etc.) of the liquid/gas mixture 152.

As further shown in FIG. 2, while not intending to be bound by theory, it has been demonstrated that in at least some implementations, a mixing ring 166 (shown in cross-section in FIG. 2) may be employed within the mixing region 160 of the head assembly 150, further enhancing the mixing of the gas supply flow 135 and the liquid spray 164 within the mixing region 160. In addition, it is believed that in at least some implementations, the mixing ring 166 may be an approximately toroidal mixing ring 166.

In some embodiments, one or more characteristics of the liquid/gas mixture dispensed by the head assembly 150 may be adjusted by varying a position of the nozzle 158 relative to the mixing region 160 along the longitudinal axis 174. For example, when the nozzle 158 is displaced at a further distance from the mixing region 160 along the longitudinal axis 174, the liquid/gas mixture 152 dispensed by the head assembly 150 may be characterized as softer, less impulsive, or mistier. Alternately, in some implementations, when the nozzle 158 is moved closer to the mixing region 160 along the longitudinal axis 174, the liquid/gas mixture 152 dispensed by the head assembly 150 may be characterized as harder, more impulsive, or more stream-like.

As further shown in FIG. 2, during at least one of the mixing (at 212) and the dispensing (at 214) by the head assembly 150, a plurality of curtain flows 168 (two shown in FIG. 2) may be drawn through the plurality of curtain-flow ports 162 into the head assembly 150. The curtain flows 168 may flow generally along an inner wall 170 of the outer housing 156, and may desirably reduce an engagement of the liquid/gas mixture 152 with the inner wall 170 of the outer housing 156 of the head assembly 150. In this way, the curtain flows 168 may advantageously reduce or eliminate an adherence of some of the liquid within the liquid/gas mixture 152 onto the inner wall 170, thereby reducing or eliminating a "plating" or "dripping" condition that may otherwise occur due to accumulation of liquid on the inner wall 170 during dispensing of the liquid/gas mixture 152 from the head assembly 150. Loss of even this small amount of the liquid stream from an already low flow rate reduces cleaning efficiency.

Referring again to FIG. 3, a portion of the liquid/gas mixture dispensed from the head assembly may be captured back into the flow of gas using the capture assembly at 216. For example, as depicted in FIG. 2, in some implementations, the capture assembly 130 may be positioned such that the intake aperture 136 is proximate to the liquid/gas mixture 152 emanating from the head assembly 150. Thus, during operation, the gas supply flow 135 drawn into the capture assembly 130 may include a recaptured portion 175 of the liquid/gas mixture 152 dispensed by the head assembly 130.

Finally, a determination is made whether operation of the shower assembly is complete at 218. If operation of the shower assembly is not complete, then the method 200 returns to providing liquid at 202, and the above-described acts 202 through 218 may be repeated indefinitely. Alternately, if operation of the shower assembly is determined to be complete at 218, then the method 200 may cease or continue to other modes of operation.

Embodiments of systems and methods in accordance with the teachings of the present disclosure may provide considerable improvements in water conservation during routine showering and cleaning operations in comparison with conventional systems. For example, systems and methods in accordance with the present disclosure may generally provide improved mixing of the liquid supply flow 155 and the gas supply flow 135, and may provide a satisfactory water application using considerably less water than conventional systems. For example, in some embodiments, the liquid supply flow 155 for a typical shower system for personal hygiene may operate satisfactorily using as little as 0.1 gallons per minute. In still other embodiments, the liquid supply flow 155 may operate satisfactorily within a range of approximately 0.1 gallons per minute to approximately 0.5 gallons per minute. Of course, for more localized applications (e.g. arms, head, etc.), such as for cleansing and treatment of wounds, even smaller flow rates may be suitably employed.

In addition, although less water is being consumed, due to the inclusion of the gas supply flow 135 into the liquid/gas mixture 150, a person using a showering system in accordance with the present disclosure may experience a fully satisfactory showering sensation. More specifically, the physical sensations (e.g. wetness, pressure, impulse, etc.) experienced by a person using such a showering system may be satisfactorily comparable to those experienced during use of conventional showering devices consuming orders of magnitude more water. In addition, because a portion 175 of the liquid/gas mixture 152 dispensed by the head assembly 150 may be re-captured and returned back to the gas supply flow 135, a moisture content (or humidity) of the gas supply flow into the head assembly may be desirably increased to improve the physical sensations experienced by the person within the liquid/gas mixture dispense by the head assembly.

The improvements in water conservation afforded by systems and methods disclosed herein may be realized in a wide variety of applications and environments, including routine showering for personal hygiene, or the cleaning of equipment, eating utensils, vehicles, and other devices. In addition, handling, treatment, and disposal of waste water resulting from the use of such systems may also be substantially reduced. For applications involving heated water, the above-noted reduction in water consumption may also lead to a correspondingly substantial reduction in energy consumption for heating the water. Other advantages provided by water-saving systems and methods in accordance with the teachings of the present disclosure will become apparent during review of the following disclosure.

Referring again to FIG. 1, in some embodiments, the housing 132 of the capture assembly 130 may include a hanger portion 140 that enables the capture assembly 130 to be suspended from a suitable support structure. More specifically, the hanger portion 140 may include an outwardly-extending portion 142 and a downwardly-extending portion 144. In some implementations, the intake aperture 136 may be disposed at any suitable location along the hanger portion 140 (FIG. 1), including at a distal end of the downwardly-extending portion 144.

Figure 4:
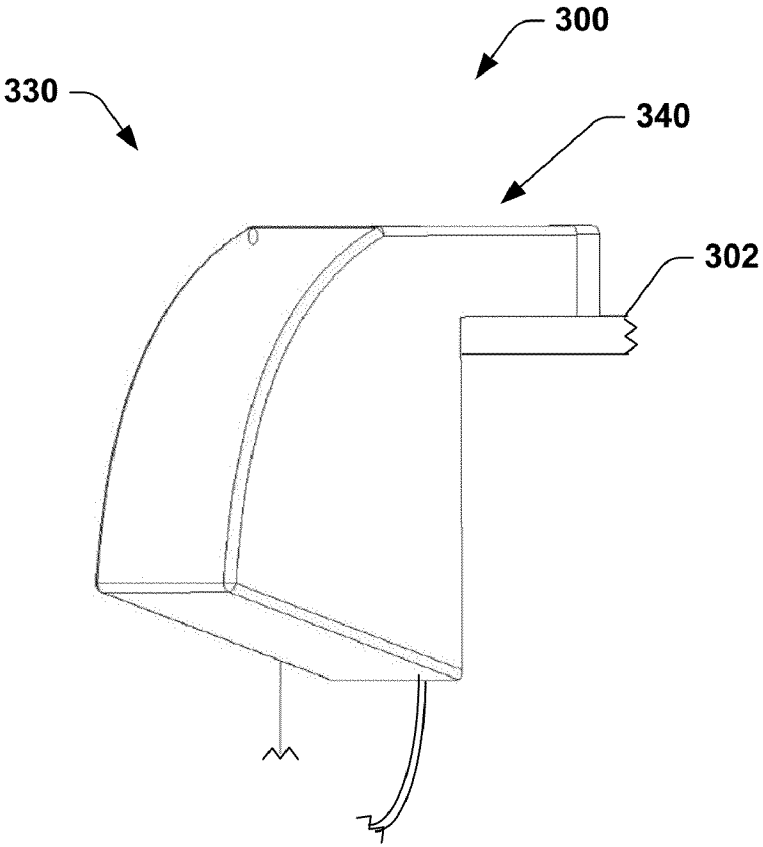

FIG. 4 is an isometric view of a portion of a shower system 300 having a capture assembly 330 in accordance with another embodiment of the present disclosure. In this embodiment, the capture assembly 330 includes a hanger portion 340 that is configured to be operatively engaged over a wall (or door) 302. Unless otherwise specified, the components and operational aspects of the shower system 300 may be substantially similar to those described above with respect to the shower system 100, and for the sake of brevity, will therefore not be described again in detail.

Figure 5:
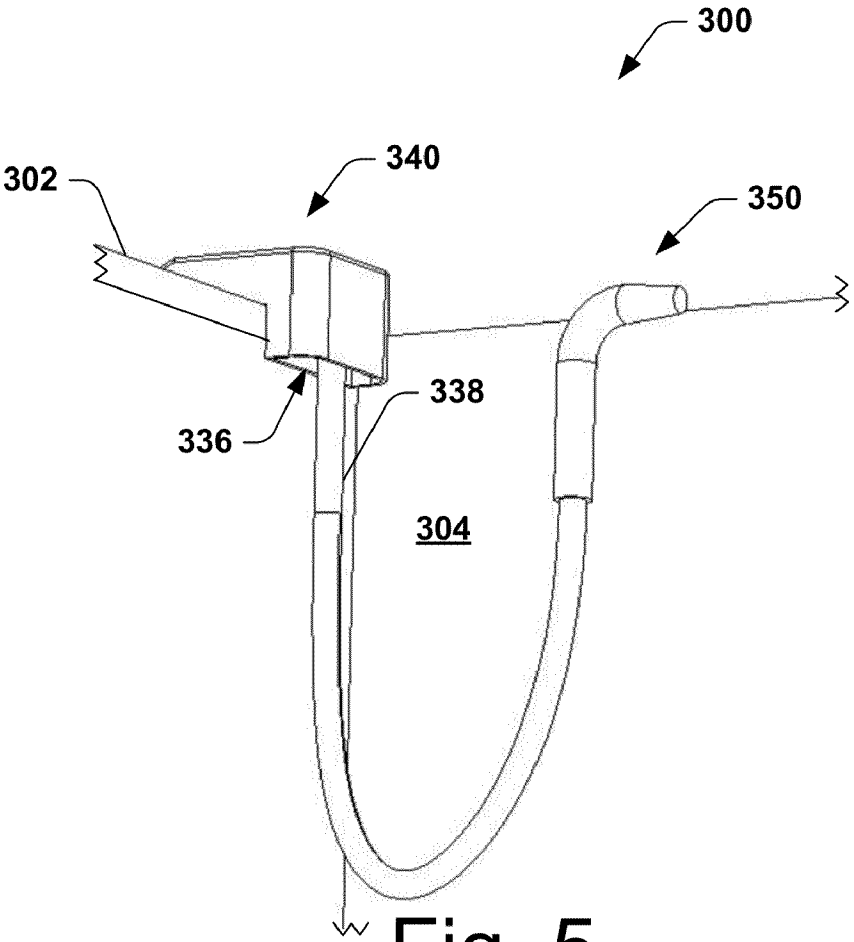
FIGS. 4 and 5 are isometric views of a shower system in accordance with another embodiment of the present disclosure.

As shown in FIGS. 4 and 5, the capture assembly 330 includes a hanger portion 340 that operatively engages the wall 302 of a shower enclosure 304 (FIG. 5). An intake aperture 336 (FIG. 5) of the capture assembly 330 is disposed through the hanger portion 340. As best shown in FIG. 4, in this embodiment, a gas supply line 338 extends from the capture assembly 330 out through the intake aperture 336 to a head assembly 350.

Embodiments of water-saving shower systems and methods in accordance with these additional aspects may provide substantial advantages over conventional systems. For example, by providing an intake aperture within a hanger portion, the intake aperture may be better positioned to recapture and return the recapture portion 175 (FIG. 2) of the liquid/gas mixture 152 dispensed by the head assembly 150 into the capture assembly. More specifically, for embodiments of showering systems that provide a dispensed liquid/gas mixture having a relatively smaller physical size or extent, embodiments in accordance with the present disclosure may advantageously position the intake aperture proximate the head assembly to be better positioned to recapture and return the recapture portion 175. For example, in some implementations, such as those configured for human showering systems for personal hygiene within a recreational vehicle or portable shower enclosure, a head assembly configured to consume approximately 0.125 gallons per minute may provide a liquid/gas mixture 152 having a typical physical extent of approximately 6 inches to 24 inches in length. For such systems, providing the intake aperture within the hanger portion may advantageously enable the shower system to properly recapture the recapture portion 175 into the recapture assembly.

Figure 6:
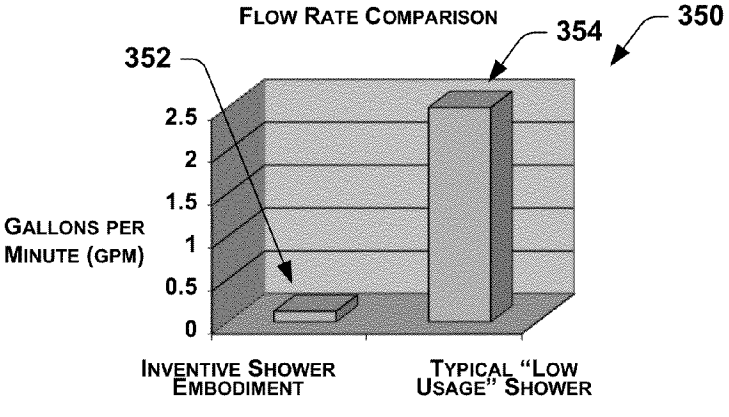

FIGS. 6-9 are bar graphs comparing performance characteristics of one or more exemplary water-saving shower systems in accordance with the present disclosure with conventional "low use" or "low flow" shower devices in accordance with the prior art. More specifically, FIG. 6 shows a bar graph 350 comparing a flow rate 352 of an embodiment of a shower system in accordance with the present disclosure with a flow rate 354 of a comparable "low usage" shower system of the prior art. The flow rate 352 of the inventive shower embodiment is approximately 20 times less than the flow rate 354 of the prior art system.

Figure 7:
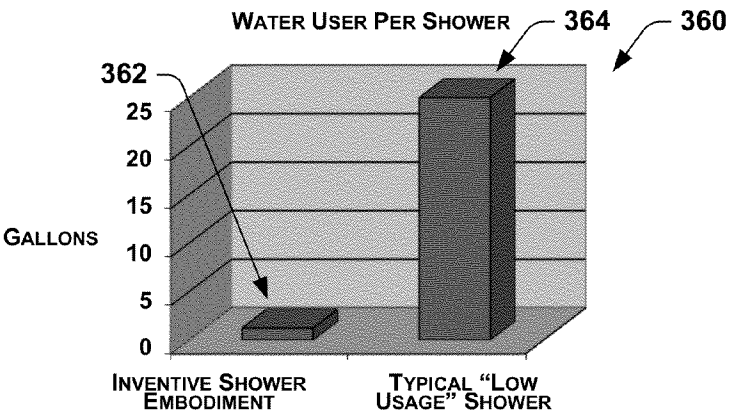
FIGS. 6-9 are bar graphs comparing performance characteristics of an exemplary water-saving shower system in accordance with the present disclosure with those of a typical "low flow" shower device of the prior art.

Similarly, FIG. 7 shows a bar graph 360 comparing an amount of water used per shower 362 (assuming a shower duration of 10 minutes) by an embodiment of a shower system in accordance with the present disclosure with a corresponding amount of water used per shower 364 by a comparable "low usage" shower system of the prior art. Again, the water use 362 of the inventive shower embodiment is approximately 20 times less than the water use 364 of the prior art system.

Figure 8:
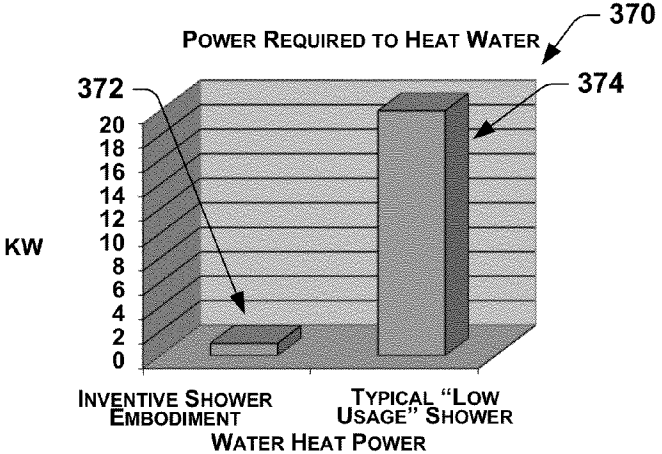

FIG. 8 shows a bar graph 370 comparing an amount of energy required to heat water per shower 372 (assuming a specific amount of added energy per gallon) by an embodiment of a shower system in accordance with the present disclosure with a corresponding amount of energy required to heat water per shower per shower 374 by a comparable "low usage" shower system of the prior art. Again, the energy required to heat water per shower 372 of the inventive shower embodiment is approximately 20 times less than the energy required to heat water per shower 374 of the prior art system.

Figure 9:
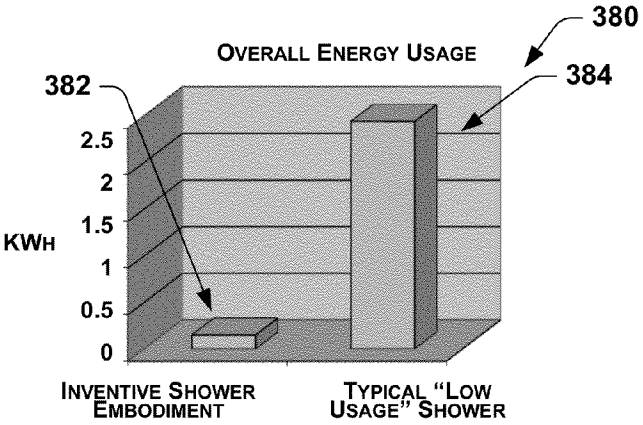

Finally, FIG. 9 shows a bar graph 380 comparing an overall amount of energy used per shower 382 by an embodiment of a shower system in accordance with the present disclosure with a corresponding overall amount of energy used per shower 384 by a comparable "low flow" shower system of the prior art. Again, the overall amount of energy used per shower 382 of the inventive shower embodiment is approximately 20 times less than the overall amount of energy used per shower 384 of the prior art system.

In addition, embodiments in accordance with the teachings of the present disclosure may provide substantial improvements in portability, mobility and ease of installation in comparison with alternate competing technologies. For example, embodiments in accordance with the present disclosure may advantageously be implemented in a "plug and play" or "do-it-yourself" manner, such that the costs associated with installation and implementation are significantly reduced. Thus, embodiments in accordance with the present disclosure may compete highly favorably in comparison with solar-based water heating technologies with typically have a relatively high installation cost and a relatively long cost recovery period.

It will be appreciated that the detailed descriptions of the above embodiments are not exhaustive descriptions of all embodiments contemplated by the inventors to be within the scope of the invention. Indeed, it will be recognized that certain aspects or elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the present disclosure. Accordingly, the scope of the invention should be determined from the following claims.

What is claimed is:

1. A shower assembly, comprising:

a liquid supply portion;

a gas supply portion; and a head assembly coupled to receive a liquid flow from the liquid supply portion and a gas flow from the gas supply portion, wherein the head assembly includes:

a body configured to define an interior chamber, the interior chamber including a mixing region configured to receive the liquid flow and the gas flow, and a dispensing portion configured to receive a combined flow from the mixing region;

a spray nozzle disposed within the body and configured to sprayably introduce the liquid flow into the mixing region;

a mixing ring depending inwardly from the body into the interior chamber to provide a flow restriction proximate the spray nozzle, the flow restriction being configured to receive at least one of the gas flow or a combination of the liquid flow and the gas flow therethrough;

wherein the body has a plurality of curtain apertures disposed therethrough at a location downstream of an initial mixing location of the sprayably introduced liquid flow and the gas flow, and configured to provide a corresponding plurality of curtain flows from a surrounding atmosphere, the plurality of curtain flows being drawn into the interior chamber and approximately along an inner wall of the dispensing portion, the combined flow and the plurality of curtain flows being dispensed out of the head assembly by the dispensing portion.

2. The shower assembly of claim 1 wherein the spray nozzle is configured to provide a conical spray of the liquid flow into the mixing region.

3. The shower assembly of claim 2 wherein the gas flow enters the mixing region approximately annularly disposed about the spray nozzle.

4. The shower assembly of claim 1 wherein the spray nozzle is moveably disposed along a longitudinal axis of the body to enable adjustment of at least one characteristic of the combined flow being dispensed from the head assembly by the dispensing portion.

5. The shower assembly of claim 1 wherein the liquid supply portion includes a liquid conduit that provides the liquid flow to the head assembly, and the gas supply portion includes a gas conduit that provides the gas flow to the head assembly, and wherein the liquid conduit is at least one of coupled to or disposed within the gas conduit.

6. The shower assembly of claim 1 wherein the gas supply portion includes a recovery intake configured to recover a portion of the combined flow dispensed from the head assembly and to reintroduce the recovered portion into the gas flow.

7. The shower assembly of claim 6 wherein the gas supply portion further includes a capture portion having a hanger portion configured to engage a support, the intake aperture being disposed within the hanger portion.

8. The shower assembly of claim 7 wherein the capture portion further includes a housing that includes the hanger portion, and a fan unit disposed within the housing, the hanger portion being configured to engage at least one of a wall, door, or curtain rod of a shower enclosure.

9. The shower assembly of claim 1 wherein the mixing ring comprises an annular mixing ring.

10. The shower assembly of claim 9 wherein the mixing ring comprises an approximately toroidal mixing ring.

11. A shower assembly, comprising:

a liquid supply portion;

a gas supply portion; and a head assembly coupled to receive a liquid flow from the liquid supply portion and a gas flow from the gas supply portion, wherein the head assembly includes:

a body configured to define an interior chamber, the interior chamber including a mixing region configured to receive the liquid flow and the gas flow, and a dispensing portion configured to receive a combined flow from the mixing region and to dispense the combined flow out of the head assembly;

a spray nozzle disposed within the body and configured to sprayably introduce the liquid flow into the mixing region; and a mixing ring disposed within the interior chamber and including an annular convex surface portion depending inwardly from the body into the interior chamber to provide a flow restriction proximate the spray nozzle, the flow restriction being configured to receive therethrough at least one of the gas flow and the combined flow;

and wherein the gas supply portion includes a recovery intake moveably positionable with respect to the head assembly and configured to recover a portion of the combined flow dispensed from the head assembly and to reintroduce the recovered portion into the gas flow.

12. The shower assembly of claim 11 wherein the gas supply portion further includes a capture portion having a hanger portion configured to engage a support, the intake aperture being disposed within the hanger portion.

13. The shower assembly of claim 12 wherein the capture portion further includes a housing that includes the hanger portion, and a fan unit disposed within the housing, the hanger portion being configured to engage at least one of a wall, door or curtain rod of a shower enclosure.

14. The shower assembly of claim 11 wherein the body has one or more curtain apertures disposed therethrough at a location downstream of an initial mixing location of the sprayably introduced liquid flow and the gas flow, and configured to provide a corresponding one or more curtain flows from a surrounding atmosphere, the one or more curtain flows being drawn through the one or more apertures and approximately along an inner wall of the dispensing portion by the combined flow, the combined flow and the one or more curtain flows being dispensed out of the head assembly by the dispensing portion.

15. The shower assembly of claim 11 wherein the spray nozzle is moveably disposed along a longitudinal axis of the body to enable adjustment of at least one characteristic of the combined flow being dispensed from the head assembly by the dispensing portion.

16. The shower assembly of claim 11 wherein the spray nozzle comprises a spray nozzle configured to provide a conical spray of the liquid flow into the mixing region.

17. A method of operating a shower assembly, comprising:

providing a liquid flow and a gas flow to a head assembly;

combining the liquid flow and the gas flow within the head assembly to form a combined flow, including sprayably introducing the liquid flow into a mixing region via a spray nozzle configured to break up the liquid flow into a plurality of droplets and disperse the plurality of droplets into the gas flow;

flowing at least one of the gas flow or the combined flow through a mixing member disposed within an interior chamber of the head assembly, the mixing member including an annular convex surface portion depending inwardly from the head assembly into the interior chamber to provide a flow restriction downstream of the introduction of the liquid flow; and dispensing the combined flow from the head assembly.

18. The method of claim 17 wherein combining the liquid flow and the gas flow within the head assembly to form a combined flow includes combining the liquid flow and the gas flow upstream of the flow restriction provided by the mixing member.

19. The method of claim 17, further comprising:

recovering a portion of the combined flow dispensed from the head assembly; and reintroducing the recovered portion into the gas flow.

20. The method of claim 19, wherein recovering a portion of the combined flow dispensed from the head assembly includes:

hanging a hanger portion of the gas supply portion on a support proximate the head assembly; and drawing the portion of the combined flow dispensed from the head assembly through an intake aperture disposed within the hanger portion.

21. A dispensing assembly, comprising:

a body having an interior chamber configured to receive at least a gas flow therethrough;

a spray nozzle disposed within the interior chamber and configured to sprayably introduce a liquid flow into the gas flow, including breaking up the liquid flow into a plurality of droplets and dispersing the plurality of droplets into the gas flow, at an initial mixing location within the interior chamber to form a combined flow, the interior chamber being further configured to exhaust the combined flow therefrom; and at least one mixing member including an annular convex surface portion depending inwardly from the body into the interior chamber to provide a restricted flow area downstream of the spray nozzle, the restricted flow area being configured to receive at least one of the gas flow or the combined flow therethrough.

22. A shower assembly, comprising:

a liquid supply portion;

a gas supply portion; and a head assembly coupled to receive a liquid flow from the liquid supply portion and a gas flow from the gas supply portion, wherein the head assembly includes:

a body configured to define an interior chamber, the interior chamber including a mixing region configured to receive the liquid flow and the gas flow, and a dispensing portion configured to receive a combined flow from the mixing region;

a spray nozzle disposed within the body and configured to sprayably introduce the liquid flow into the mixing region;

a mixing ring depending inwardly from the body into the interior chamber to provide a flow restriction proximate the spray nozzle, the flow restriction being configured to receive at least one of the gas flow or a combination of the liquid flow and the gas flow therethrough;

wherein the body has a plurality of curtain apertures disposed therethrough at a location downstream of the mixing ring, and configured to provide a corresponding plurality of curtain flows from a surrounding atmosphere, the plurality of curtain flows being drawn into the interior chamber and approximately along an inner wall of the dispensing portion, the combined flow and the plurality of curtain flows being dispensed out of the head assembly by the dispensing portion.

23. A shower assembly, comprising:

a head assembly including:

a body configured to define an interior chamber, the interior chamber including a mixing region configured to receive a liquid flow and a gas flow, and a dispensing portion configured to receive a combined flow from the mixing region and to dispense the combined flow out of the head assembly;

a spray nozzle configured to sprayably introduce the liquid flow into the mixing region; and a gas supply portion including a housing having an intake aperture configured to receive a flow of gas, wherein the housing includes an approximately hook-shaped hanger portion configured to engage a support to suspend the housing, the intake aperture being disposed within the hanger portion.

24. The method of claim 17 wherein the spray nozzle is further configured to disperse the plurality of droplets into the gas flow via a conical spray.

25. The assembly of claim 21 wherein the spray nozzle is further configured to disperse the plurality of droplets into the gas flow via a conical spray.

* * * * *